US005825260A

United States Patent [19]

Ludwig et al.

[11] Patent Number: 5,825,260

[45] Date of Patent: Oct. 20, 1998

[54] DIRECTIONAL COUPLER FOR THE HIGH-FREQUENCY RANGE

[75] Inventors: Michael Ludwig, Erbach; Ralf Rieger, Andelfingen, both of Germany

[73] Assignee: Daimler-Benz Aerospace AG, Munich, Germany

[21] Appl. No.: 801,418

[22] Filed: Feb. 18, 1997

[30] Foreign Application Priority Data

Feb. 15, 1996 [DE] Germany ..... 196 05 569.5

[51] Int. Cl.[6] ..... H01P 5/18

[52] U.S. Cl. ..... 333/116; 333/246

[58] Field of Search ..... 333/115, 116

[56] References Cited

U.S. PATENT DOCUMENTS

| | | | |
|---|---|---|---|
| 3,012,210 | 12/1961 | Nigg | 333/116 |
| 3,593,208 | 7/1971 | Smith | 333/116 X |
| 4,011,528 | 3/1977 | Podell et al. | 333/116 X |
| 4,799,032 | 1/1989 | Sugarawa | 333/116 |
| 4,999,593 | 3/1991 | Anderson | 333/116 X |
| 5,166,690 | 11/1992 | Carlson et al. | 342/187 |

FOREIGN PATENT DOCUMENTS

| | | | |
|---|---|---|---|
| 2 722 032 A | 1/1996 | France . | |
| 4-280101 | 10/1992 | Japan | 333/116 |

OTHER PUBLICATIONS

S.L. March: "Phase Velocity Compensation In Parallel--Coupled Microstrip" 1982 IEEE MTT–S International Microwave Symposium–Digest, 15–17, Jun. 1982, Dallas (US), pp.410–412, XP002060929.

S. Toyoda: "Variable coupling Directional Couplers Using Varactor Diodes", 1982 IEEE MTT–S International Microwave Symposium–Digest, 15–17, Jun. 1982, Dallas (US), pp. 419–421, XP002061019.

*Primary Examiner*—Paul Gensler

*Attorney, Agent, or Firm*—Spencer & Frank

[57] ABSTRACT

A directional coupler that can be produced entirely in integrated technology (MIC or MMIC), particularly for the X-band. The directional coupler can be designed for a high coupling attenuation (>30 dB) and a high directivity (>30 dB) with a large relative bandwidth (approximately 20%). This is achieved with a stepped arrangement comprising a plurality of λ/4 waveguide sections and coupling capacitors disposed between the respective paths of the coupler.

9 Claims, 2 Drawing Sheets

DIRECTIONAL COUPLER FOR THE HIGH-FREQUENCY RANGE

CROSS REFERENCE TO RELATED APPLICATIONS

This application claims the priority of German patent application No. DE 196 05 569.5, filed Feb. 15, 1996, which is incorporated herein by reference.

BACKGROUND OF THE INVENTION

The invention is based on a directional coupler for the high-frequency range consisting of at least a through path and a coupling path, with the two paths being configured as waveguides in accordance with integrated technology, and at least one coupling or connector point in each path for coupling the waves conducted in the respective waveguides between the through and coupling paths.

In high-frequency technology, particularly radar technology, directional couplers are used in numerous applications, for example to couple out a high-frequency signal (HF signal) or to couple an HF calibration signal into an HF circuit arrangement. For applications of this nature, directional couplers are known which are configured according to different technologies, for example in the so-called drop-in technique, as triplate arrangements, as waveguide couplers or as coaxial couplers.

These types of couplers are generally designed as discrete components, and therefore consume a great deal of space and are cost-prohibitive, particularly in industrial mass production of HF arrangements that must all possess identical electrical properties and be spatially small and mechanically sturdy. Examples of these HF arrangements are transmitting/receiving modules (T/R modules) for phase-controlled antennas. This type of antenna requires numerous T/R modules, for example a few thousand, which must be disposed closely together, for example with grid spacing of $\lambda/4$, where $\lambda$ is the wavelength of transmitting/receiving frequency, for example a few GHz. Accordingly, this type of arrangement must be produced with high electrical precision and aligned if the antenna is required to operate with high precision. Therefore, each T/R module requires, for example, at least one coupler, which is inserted into the circuit arrangement at a predetermined measuring point for coupling out, for example, an HF signal for testing, calibrating and/or measuring purposes. It is apparent that couplers suited for these purposes must likewise be highly precise and, moreover, must possess the lowest possible predetermined tolerances of their electrical properties among themselves. In the couplers mentioned at the outset, however, this can only be achieved with a high outlay for integration and alignment, which is particularly cost-prohibitive in mass production.

A readily apparent way to avoid these disadvantages is to use couplers that can be manufactured entirely in accordance with integrated technology. Such a coupler includes a (primary) waveguide that is coupled to a further waveguide, for example, a $\lambda/4$ waveguide, forming a line coupling. These couplers generally require further, passive components (reactances) to effect problem-free coupling in or out of HF signals.

A disadvantage shared by these couplers, therefore, is that they are also technically expensive and are therefore particularly cost-prohibitive in mass production.

It is therefore the object of the invention to disclose a generic coupler that can be mass-produced cost-effectively and reliably in accordance with integrated conduction technology to possess predetermined tolerances of the electrical properties.

SUMMARY OF THE INVENTION

The above object generally is achieved according to the present invention by a directional coupler for the high-frequency range, which comprises, in combination:

a through path and a coupling path, with each extending between respective ports, and with the through and coupling paths each being configured as waveguides in accordance with integrated waveguide technology; at least two coupling points for coupling waves, which are conducted in the waveguides, between the through and coupling paths are present in each path in the direction of propagation of an incident TEM mode fed to one port of the through path; each waveguide section in each path disposed between two adjacent of the coupling points has an electrical length equal to $\lambda/4$, where $\lambda$ indicates the wavelength of the wave conducted in the waveguides; and, a respective coupling capacitor is connected between associated respective coupling points of the through and coupling paths.

Advantageous embodiments and/or modifications of the invention can be derived from the description below.

A first advantage of the invention is that the coupler can be produced entirely in accordance with a conduction technology, for example microstrip technology, that is suited for the wavelength (frequency) of the conducted signals. Discrete components, which would otherwise have to be inserted into the circuit arrangement, for example through a soldered, adhesive or bonded connection, are not required. It is advantageous that this causes no other electrical impact points at which disturbing reflections of the conducted wave could occur.

A second advantage is that virtually loss-free couplers can be produced. In other words, virtually no signal occurs at the isolation path (isolation port) that is otherwise converted, with a corresponding matched load (HF termination), into (lost) heat. A negligible reflection advantageously occurs at the input port.

A third advantage is that broadband couplers can also be produced with high directivity and high coupling attenuation.

A fourth advantage is that no line coupling is present, so no disturbing dispersion effects can occur.

Further advantages ensue from the following description.

The invention is described in detail below by way of an embodiment, with reference to the drawing.

DETAILED DESCRIPTION OF THE PREFERRED EMBODIMENT

The disclosed embodiment of the invention relates to a coupler in the highest-frequency range (X-band, that is, 8 GHz to 12 GHz) for coupling out an HF signal component, particularly for testing, calibrating and measuring purposes.

Figure 1:
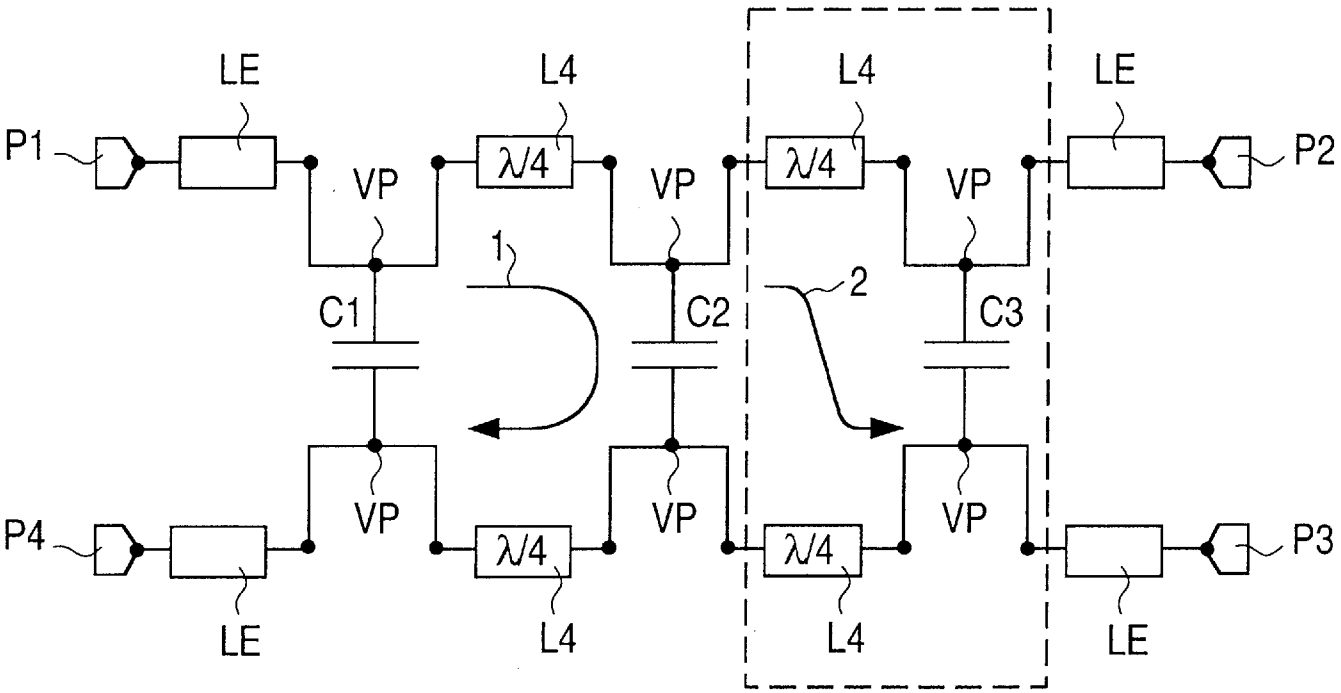
FIG. 1 is a schematic circuit diagram of a preferred embodiment of high frequency directional couplers according to the invention.

The coupler is designed entirely in accordance with a microstrip line technology suited for this frequency range. The coupler as shown in FIG. 1 advantageously possesses a completely symmetrical design with respect to ports P1 through P4, so terms that characterize a coupler, such as through path, coupling path, input port and isolated port, can be used. Consequently this coupler is, a flexible adaptation to other circuit and/or layout requirements is possible with the same so-called circuit layout of the coupler. For example, any of the four ports can be used as the isolated port.

In the illustrated example, it is assumed that the port P1 is the input port, into which an HF input signal can be fed. The direct path between the port P1 and the port P2 (output port) is referred to as the through path. The path between the ports P3 and P4 is referred to as the coupling path. Because a so-called forward coupling is used in the coupler, the signal to be coupled out (measured signal) results at the (coupling) port P3, which will be explained in detail below. The port P4 is the isolated port, at which a negligible signal component occurs in any case that can be additionally supplied to an HF matched load (HF termination) if needed. The through path and coupling path are microstrip waveguides. The coupling between these paths is effected via a predetermined number of coupling capacitors C1 through C3, which can also be advantageously produced in accordance with microstrip line technology, for example through a precisely predetermined line interruption (line gap or spacing) of a corresponding waveguide.

According to FIG. 1, both the through path and coupling path each comprise a respective series connection of a pair of input conductors LE, each adjacent to a respective port P1, P2, or P3, P4, and a predetermined number of waveguide sections L4 that have the electrical length $\lambda/4$ ($\lambda/4$ waveguide sections), where $\lambda$ is the wavelength of the conducted wave. The coupling capacitors C1 through C3 are disposed between the through and coupling paths at the connecting or coupling points VP between the aforementioned line segments LE, L4, L4, LE. This connecting points are configured in accordance with line technology as, for example, so-called T-junctions.

If an HF signal (incident TEM mode) is now coupled into the input port P1, the signal is conducted through the through path to the output port P2. Furthermore, a TEM mode is excited in the coupling path via the coupling capacitors C1 through C3. In principle, this TEM mode can propagate in two opposite directions in the coupling path, namely in the desired, forward direction indicated by reference numeral 2, that is, from the isolated port P4 in the direction of the (coupling) port P3 (i.e., parallel to the direction of propagation of the TEM mode incident at the port P1), or in the opposite, undesirable backward direction indicated by reference numeral 1, that is, in front of the (coupling) port P3 in the direction of the isolated port P4. With the described arrangement, all TEM modes propagating in the forward direction 2 in the coupling path are advantageously superimposed constructively, i.e., a phase difference of essentially 0° exists between them. In contrast, a phase difference of essentially 180° always exists between the TEM modes coupled in via the coupling capacitors C1 through C3 and propagating in the backward direction 1; in other words, a destructive superimposition exists. The TEM modes running in the backward direction 1 are mutually canceled (through interference), so a negligible signal component is always present at the isolated port P4.

Because of the above-described symmetrical design of the coupler, it is apparent that TEM modes can again be excited in the through path by the TEM mode conducted in the forward direction 2 in the coupling path. These modes can now only be constructively superimposed in the direction of propagation of the incident TEM mode, i.e., they can only be present at the (output) port P2. A negligible signal component can also be present at the input port P1. This component is generally characterized as the reflective component.

It is apparent that the maximum power that can be coupled out at the (coupling) port P3, also characterized by the so-called coupling attenuation in the literature, is a function of the capacity of the coupling capacitors C1 through C3.

The relative (frequency) bandwidth of the coupler can be set by the number of its stages. A stage enclosed by a dashed line in FIG. 1 comprises a $\lambda/4$ line piece L4 in each path and an associated coupling capacitor. The relative bandwidth becomes larger if the number of stages is increased.

It is apparent that the dimensioning of the illustrated components (line pieces LE, L4 and the coupling capacitors) are a function of, among other things, the absolute value of the power to be coupled out at the (coupling) port P3. Precise dimensioning of the components is permitted by a network calculation familiar to one skilled in the art.

Couplers of this type can be characterized by the relative variables of (relative) bandwidth, coupling attenuation (ratio of the power coupled out at the (coupling) port P3 to the power coupled in at the (input) port P1) as well as the directivity. The directivity characterizes the ratio of the power coupled out at the (coupling) port P3 to the power that can be coupled out at the isolated port P4.

With the described arrangement, that is, three coupling capacitors C1 through C3 and respectively two $\lambda/4$ lines L4 in each path, it is possible to produce a coupler in accordance with, for example, microstrip technology that has a relative bandwidth of approximately 20% in the X-band (8 GHz to 12 GHz) and a directivity greater than 30 dB with a coupling attenuation of approximately 30 dB.

Couplers of this type can therefore be implemented advantageously in circuit arrangements that are currently most common in highest-frequency technology, for example in so-called MICs (Microwave Integrated Circuits) and MMICs (Monolithic Microwave Integrated Circuits). An advantage is that additional discrete components (e.g. coaxial couplers) that would otherwise be necessary can be omitted, considerably decreasing production costs. Moreover, these couplers are mechanically sturdy (insensitive with respect to shock stress), and can be mass-produced reliably with reproducible results, that is, within a predetermined tolerance range of the electrical properties.

Figure 2:
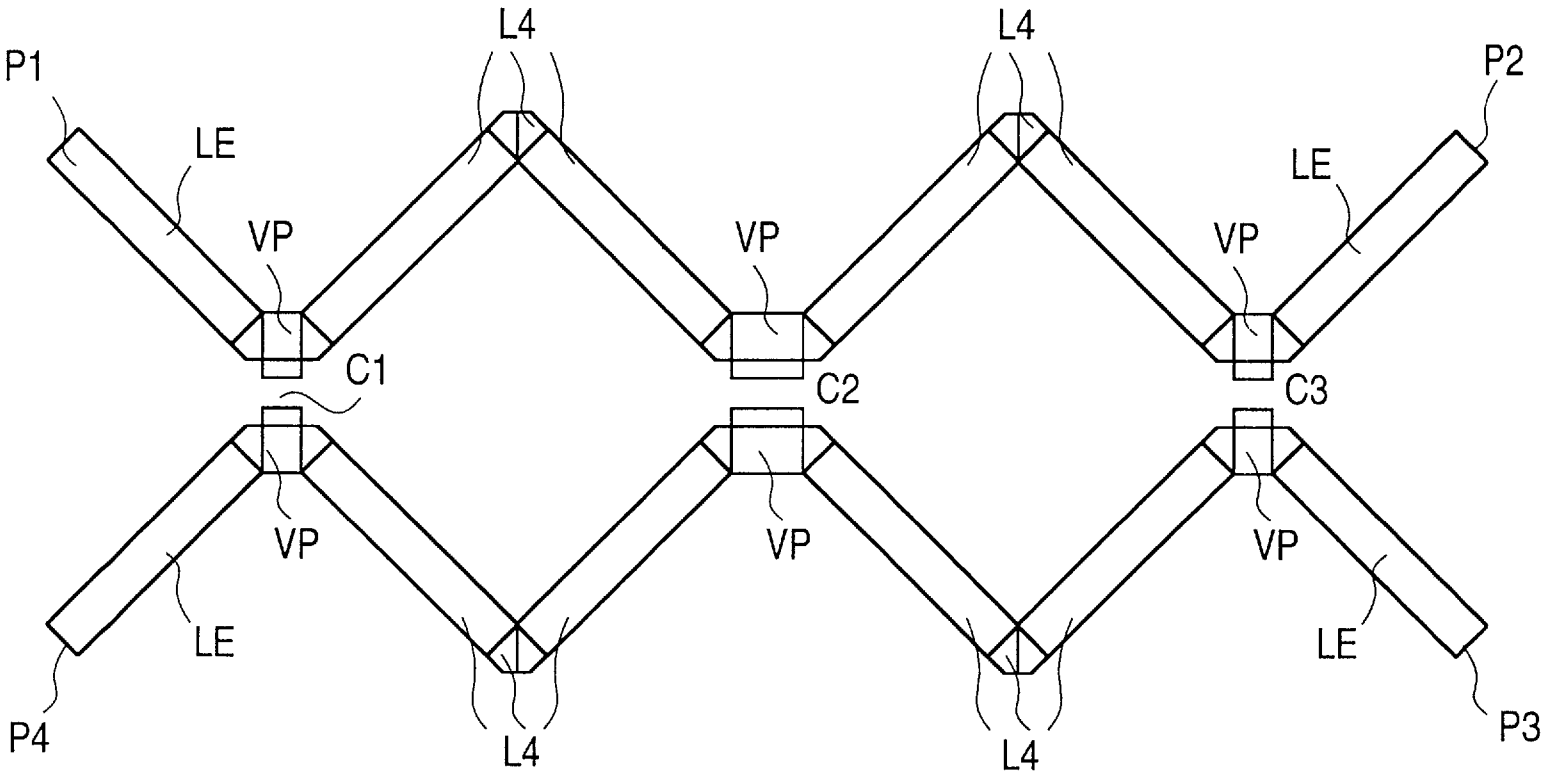
FIG. 2 shows an example of an outline drawing of such a directional coupler in microstrip technology.

The invention is not limited to the described example, but can be applied to others in the same sense. For example, a person skilled in the art can readily transpose the arrangement shown in the drawing into virtually any frequency range using the network theory. FIG. 2 shows an example of an outline drawing of a high frequency directional coupler according to the invention in microstrip technology. This outline drawing corresponds to the disclosed embodiment in FIG. 1. FIG. 2 illustrates that the coupling capacitors C1, C2 and C3 are produced as line interruptions, while the connecting points VP between the line segments LE, L4, L4 and LE are configured as so-called T-Junctions. Here, the line segments are arranged as straight microstrip lines in certain angles to the connecting points, but they also can be arranged in different angles or as curved bends. The electrical length of the line segments L4 is about $\lambda/4$ at the desired center frequency. The length of the line segments LE is arbitrarily chosen and can be adjusted to the dimensional environment. The dimensions of the line interruptions C1, C2 and C3 are chosen dependent on the desired electrical performance (coupling, directivity).

The invention now being fully described, it will be apparent to one of ordinary skill in the art that any changes and modifications can be made thereto without departing from the spirit or scope of the invention as set forth herein.

What is claimed:

1. A directional coupler for the high-frequency range, comprising, in combination:

a through path and a coupling path, each extending between respective ports, and with the through and coupling paths each being symmetrically configured as sections of flat conductors in integrated waveguide technology;

at least three coupling points for coupling waves, which are conducted in the flat conductors, between the through and coupling paths are present in each path in the direction of propagation of an incident TEM mode fed to one port of the through path;

each flat conductor section in each path disposed between two adjacent of the coupling points has an electrical length equal to $\lambda/4$, where $\lambda$ indicates the wavelength of the wave conducted in the flat conductors; and, a respective coupling capacitor is connected between associated respective coupling points of the through and coupling paths.

2. The directional coupler as defined in claim 1, wherein the coupling points are configured as junctions in integrated waveguide technology.

3. The directional coupler as defined in claim 1, wherein the coupling capacitors are configured as a flat conductor line interruption in integrated waveguide technology.

4. The directional coupler as defined in claim 1, wherein the capacity of the respective coupling capacitors is selected as a function of the HF power to be coupled into the coupling path from the through path.

5. The directional coupler as defined in claim 1, wherein the same number of coupling points and the same number of $\lambda/4$ flat conductor sections are present in each path, and that the numbers of coupling points and $\lambda/4$ flat conductor sections, as well as the number of the coupling capacitors between the paths, are selected as a function of a predetermined relative frequency bandwidth of the coupler.

6. The directional coupler as defined in claim 1, wherein the coupling points, $\lambda/4$ flat conductor sections and coupling capacitors are designed in integrated waveguide technology for the radar frequency range.

7. The directional coupler as defined in claim 1, wherein the integrated waveguide technology is microstrip technology.

8. The directional coupler as defined in claim 1, wherein at least the coupling capacitors are designed for a high predetermined coupling attenuation of the coupler.

9. The directional coupler as defined in claim 1, wherein the coupler is designed for use in the X-band (8 GHz to 12 Ghz).

* * * * *